US011417300B2

(12) United States Patent
Kim

(10) Patent No.: US 11,417,300 B2
(45) Date of Patent: Aug. 16, 2022

(54) SALIVA COLLECTOR FOR BRASS MUSICAL INSTRUMENT

(71) Applicant: Young-Tae Kim, Seoul (KR)

(72) Inventor: Young-Tae Kim, Seoul (KR)

( * ) Notice: Subject to any disclaimer, the term of this patent is extended or adjusted under 35 U.S.C. 154(b) by 0 days.

(21) Appl. No.: 16/772,728

(22) PCT Filed: Dec. 13, 2018

(86) PCT No.: PCT/KR2018/015827

§ 371 (c)(1),
(2) Date: Jun. 12, 2020

(87) PCT Pub. No.: WO2019/117643

PCT Pub. Date: Jun. 20, 2019

(65) Prior Publication Data

US 2020/0320963 A1 Oct. 8, 2020

(30) Foreign Application Priority Data

Dec. 15, 2017 (KR) ..... 10-2017-0173252

(51) Int. Cl.
*G10D 7/10* (2006.01)
*G10D 9/00* (2020.01)

(52) U.S. Cl.
CPC ..... *G10D 7/10* (2013.01); *G10D 9/00* (2013.01)

(58) Field of Classification Search
CPC ..... G10D 9/00; G10D 7/10; G10G 7/00
See application file for complete search history.

(56) References Cited

U.S. PATENT DOCUMENTS 4,016,794 A 4/1977 Brown

FOREIGN PATENT DOCUMENTS

| | | | | | |
|---|---|---|---|---|---|
| JP | 10293575 | A | | 11/1998 | |
| JP | H10-293575 | A | | 11/1998 | |
| JP | 2004-151615 | A | | 5/2004 | |
| JP | 2004151615 | A | | 5/2004 | |
| JP | 2015-055654 | A | | 3/2015 | |
| JP | 2015055654 | A | * | 3/2015 | ..... G10D 9/00 |
| JP | 2015055654 | A | | 3/2015 | |
| KR | 10-2005-0000900 | A | | 1/2005 | |
| KR | 20050000900 | A | | 1/2005 | |

OTHER PUBLICATIONS

International Search Report of PCT/KR2018/015827, dated Mar. 11, 2019, 9 pages.

* cited by examiner

*Primary Examiner* — Kimberly R Lockett
(74) *Attorney, Agent, or Firm* — Muncy, Geissler, Olds & Lowe, P.C.

(57) ABSTRACT

The present invention relates to a saliva collector which comprises: a container which provides a space to accommodate at least one absorber; and a head wherein one end is detachably disposed on at least one part of a musical instrument and another end is detachably disposed so as to communicate with at least one part of a side of the container.

11 Claims, 8 Drawing Sheets

(a)

(b)

(a)

(b)

SALIVA COLLECTOR FOR BRASS MUSICAL INSTRUMENT

TECHNICAL FIELD

The present invention relates to a saliva collector for a brass instrument.

BACKGROUND ART

In general, to solve problems related to oil, saliva, and other liquids when a brass instrument including a trumpet, a trombone, a horn, a tuba, and the like is played, a collector which discharges such liquids from a water valve of the brass instrument and stores the liquids is necessary.

In the case of a brass instrument formed of metal materials, when the brass instrument is played, saliva of a player flows thereinto due to a structure thereof.

Due to the saliva of the player which flows into the instrument, a temperature inside the brass instrument increases such that a temperature difference occurs between inside and outside of the brass instrument.

Due to the temperature difference, inside the brass instrument, a mixture, in which the saliva of the player and a liquid generated by the temperature difference are mixed, pool to be accumulated inside the brass instrument.

To solve this, the brass instrument may include a plurality of water valves to discharge the mixture generated during performance or playing.

The player may discharge the mixture accumulated inside the brass instrument to the outside by opening the water valves when the player desires.

However, since there are many cases in which a pressure inside the instrument is increased to play the brass instrument, there is a problem that the mixture is discharged through a lid of the water valve while the water valve is not opened.

As described above, externally-discharged mixtures pool on the floor such that it is inconveniently necessary for players to clean the floor after performance or playing. Also, people therearound feel discomfort with contamination of the floor caused by mixtures including saliva of players.

DISCLOSURE

Technical Problem

The present invention is directed to providing a saliva collector for a brass instrument, which prevents a mixture from accumulating in the brass instrument, to prevent inconvenience to players in cleaning the floor and to prevent people therearound from feeling discomfort due to mixtures including saliva of players.

Technical Solution

One aspect of the present invention provides a saliva collector including a container configured to provide a space which accommodates at least one absorber and a head which has one end provided to be detachable from at least a part of an instrument and the other end provided to be detachable to communicate with at least a part of one surface of the container.

The container may include a head coupling portion provided on one end of the container and coupled to the head, a container opening portion provided on the other end of the container to provide an inlet through which the absorber moves in or out, and a container lid portion provided to be detachable from the container opening portion. The head may include an instrument coupling portion provided on one end of the head to provide a space which accommodates the at least a part of the instrument and provided to be couplable to at least a part of the instrument using a fitting method, a container coupling portion provided on the other end of the head and pivotably coupled to the container, and a saliva flow path portion which has one end provided on the instrument coupling portion and the other end provided on the container coupling portion to provide a flow path through which saliva discharged from the instrument moves.

The head coupling portion may include at least one container rib provided to protrude inward to a certain height. Also, the container coupling portion may include at least one head recess provided to be recessed to a certain height to accommodate the container protruding portion, and the head recess may include at least one tapered surface provided at a bottom to be tilted at a certain angle.

The instrument coupling portion may include at least one rib provided on an outer surface of the instrument coupling portion to protrude to a certain height.

A first surface of the head may include a first protruding portion disposed to protrude from the first surface to a certain height and having a hollow shape through which saliva flowing from the instrument is discharged and a first gap portion formed on an outer circumferential surface of the first protruding portion. A second surface of the head may include a second protruding portion disposed on the second surface to protrude to a certain height and a second gap portion formed on an outer circumferential surface of the second protruding portion. The container may include a hollow container accommodation portion disposed on one surface of the container to protrude to a certain height and in which the first protruding portion or the second protruding portion is accommodated.

When the container and the head are coupled, an inner surface of the container accommodation portion may be provided to come into surface contact with an outer surface of the first protruding portion or an outer surface of the second protruding portion.

The container may be formed of a transparent material, and the absorber may be provided to vary in color when a preset amount or more of water is absorbed.

The instrument coupling portion may include a hook provided on one surface of the instrument coupling portion to protrude to a certain height and a strap provided in a strap shape on the one surface of the instrument coupling portion and including a hook opening portion into which the hook is inserted.

The container may include a first pole plate provided inside the container to come into contact with one surface of the absorber, a second pole plate provided inside the container to come into another surface of the absorber, a light emitting diode (LED) which has one end provided to be electrically connected to the first pole plate and the other end provided to be electrically connected to the second pole plate and which emits light when a preset amount or more of water is absorbed by the absorber, and an LED opening portion provided on one surface of the container to accommodate the LED.

The head may further include a sealing structure provided to extend downward.

A top surface of an inside of the head may include a plurality of holes and a plurality of slits.

The head may include a button portion in a lateral surface, which is configured to provide a space in which a lateral part of a water key provided in the instrument is accommodated.

Advantageous Effects

According to the present invention, a saliva collector for a brass instrument may prevent a mixture from accumulating in the brass instrument to prevent inconvenience to players in cleaning the floor and to prevent people therearound from feeling discomfort due to mixtures including saliva of players.

DESCRIPTION OF DRAWINGS

The following attached drawings are for understanding the present invention, and a detailed description and embodiments of the present invention will be provided. However, the technical features of the present invention are not limited to a particular drawing, and features shown in each drawing will be combined with each other to form a new embodiment.

MODES OF THE INVENTION

Hereinafter, a device and a variety of methods to which embodiments of the present invention are applied will be described in detail with reference to the drawings. Hereinafter, the terms "module" and "portion" with respect to components used herein will be given or used in consideration of only ease in drafting the specification and do not have meanings or functions which are distinguished from one another.

Although it has been described above that all components which form the embodiments of the present invention are coupled or coupled to operate as one, the present invention is not limited to the embodiments. That is, within the scope of the present invention, all components may be selectively coupled to operate as one or more.

Also, since the term "comprise," "include," "have," or the like, unless particularly defined otherwise, means that a corresponding component can be included, it should be construed that another component is not excluded and may be further included. All the terms used herein including technical or scientific terms, unless defined otherwise, have the same meanings generally understood by one of ordinary skill in the art. Generally used terms such as the terms defined in dictionaries should be understood as having meanings which coincide with contextual meanings of the related art and will not be understood as ideally or excessively formal meanings unless clearly defined.

Also, in describing components of the embodiments of the present invention, the terms such as first, second, A, B, (a), (b), and the like may be used. These terms are merely for distinguishing one element from another, and the essential, order, sequence, and the like of corresponding elements are not limited by the terms. When it is stated that one component is "connected," "coupled," or "joined" to another component, it should be understood that the one component may be directly connected or coupled to the other component but still another component may be "connected," "coupled," or "joined" between the components.

Figure 1:
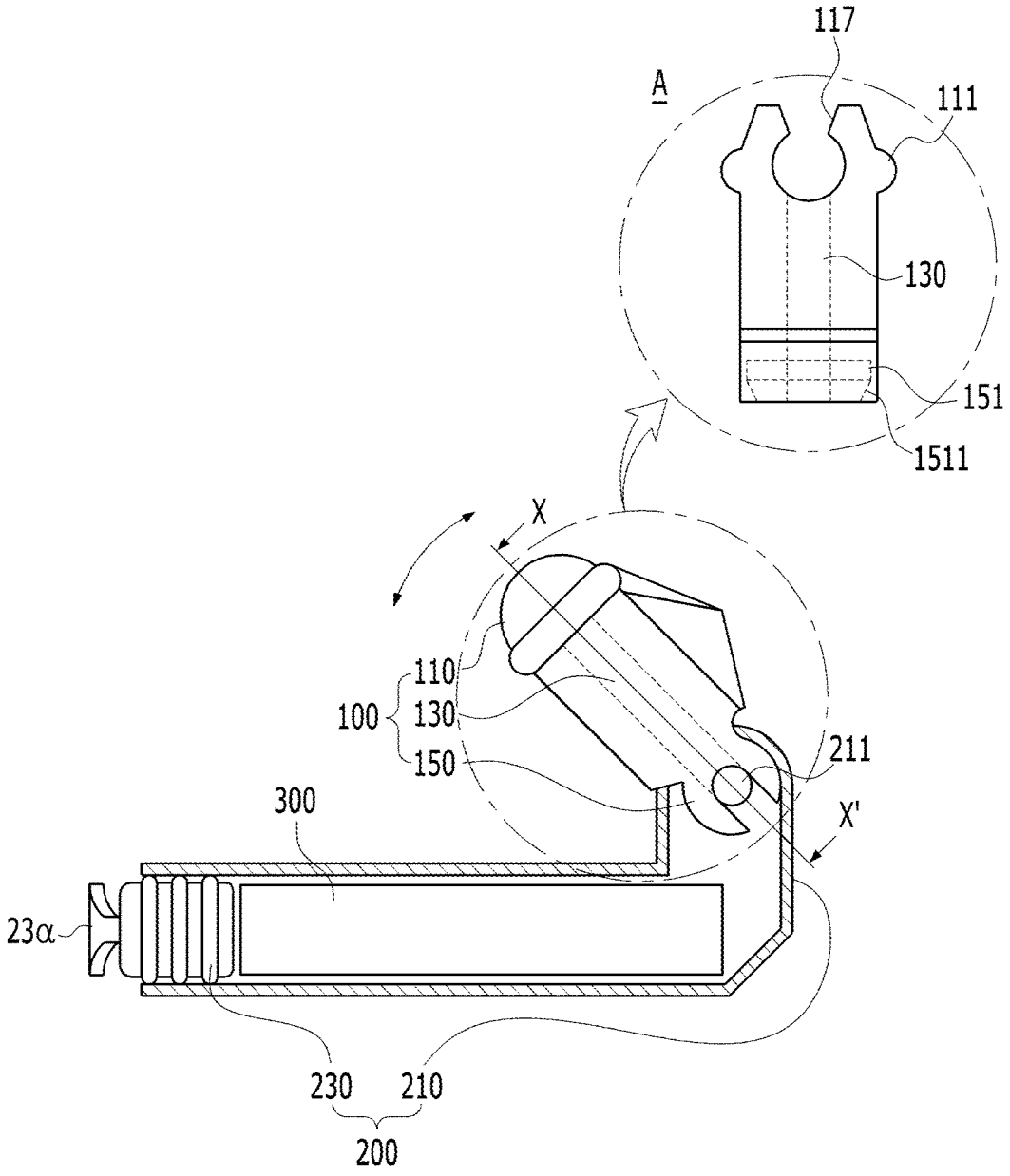
FIG. 1 illustrates a saliva collector according to one embodiment of the present invention.

FIG. 1 illustrates a saliva collector according to one embodiment of the present invention.

Referring to FIG. 1, the saliva collector of the embodiment may include a container 200, which provides a space accommodating at least one absorber 300, and a head 100 which has one end provided to be detachable from at least a part of a musical instrument (not shown) and the other end detachably provided to communicate with at least a part of one surface of the container 200.

In more detail, the head 100 may include an instrument coupling portion 110 which is provided at one end of the head 100, includes an accommodation space accommodating at least a part of the instrument, and is provided to be couplable to the at least part of the instrument using a fitting method, a container coupling portion 150 provided at the other end of the head 100 and pivotably coupled to the container 200, and a saliva flow path portion 130 which has one end provided at the instrument coupling portion 110 and the other end provided at the container coupling portion 150 to provide a flow path through which saliva discharged from the instrument flows.

The instrument coupling portion 110 of the embodiment may include an instrument coupling rib 111 provided on at least one surface to protrude outward at a certain height.

Here, the instrument coupling portion 110 may include a certain space for accommodating a part of the instrument therein. Since a user does not always couple the saliva collector of the embodiment to the instrument to use and may couple the saliva collector to the instrument to use only when necessary, when the head 100 and the instrument are detached, a certain stress concentration effect occurs at one part of the instrument coupling portion 110 such that the instrument coupling portion 110 is destroyed.

Accordingly, to solve this, since the instrument coupling portion 110 includes the instrument coupling rib 111 provided at a place of the instrument coupling portion 110 where the stress is concentrated and provided to protrude outward at a certain height, there is an effect of preventing the instrument coupling portion 110 from being destroyed.

Also, the instrument coupling portion 110 of the embodiment may include an instrument coupling portion tapered surface 117 provided at a part, on which the instrument coupling portion 110 and the instrument are coupled, to be tilted at a certain angle.

As described above, in a case in which the saliva collector of the embodiment is mounted on the instrument according to user's needs, the instrument and the instrument coupling portion 110 may interfere with each other such that the instrument is damaged when the instrument coupling portion tapered surface 117 is not present.

Accordingly, to prevent this, at least a part of an inner surface of the instrument coupling portion 110 may be configured to include the instrument coupling portion tapered surface 117 provided to have a surface, which is to be coupled to the instrument, to be tilted at a certain angle.

Also, as shown in FIG. 1, the saliva flow path portion 130 may be provided from the instrument coupling portion 110 to the container coupling portion 150. However, providing a flow path through which saliva collected from the instrument passes the head 100 and moves toward the container 200 is sufficient. The user may use the saliva flow path portion 130 with a variety of changes in shape and length thereof as necessary.

The container 200 may include a head coupling portion 210 provided at one end of the container 200 to be coupled to the head 100, a container opening portion (not shown) provided at the other end of the container 200 to provide an inlet through which the absorber 300 moves in and out, and a container lid portion 230 detachably provided at the container opening portion.

Also, the head coupling portion 210 may include at least one container rib 211 provided to protrude at a certain height toward the inside of the container 200. The container coupling portion 150 may include at least one head recess 151 provided to be recessed at a certain height to accommodate the container rib 211.

A cross section of the container rib 211 may be provided as a circular shape as shown in FIG. 1 so that the head 100 may be provided to be pivotable on the container rib 211 as a pivoting axis.

In the embodiment, at least one head recess 151 may be provided at a lower portion and further include a head recess tapered surface 1511 provided to be tilted at a certain angle.

Here, the user may use the saliva collector of the embodiment while the head 100 and the container 200 are attached or detached as necessary. When the head recess 151 does not include the head recess tapered surface 1511, it is difficult to couple one end of the head 100 to one end of the container due to interference therebetween.

Accordingly, since the head recess tapered surface 1511 is provided, there is an effect of more easily coupling the head 100 to the container 200.

Also, the container lid portion 230 of the embodiment may be formed of a silicone material and further include a lid strap 2301 at one end.

The lid strap 2301 may have a shape in which an upper or lower area is larger than a lateral area.

When it is necessary for the user to detach the container lid portion 230 from the container 200 to exchange the absorber 300, the lip strap 2301 having the shape in which the upper or lower area is larger than the lateral area is provided at the one end of the container lid portion 230 such that the user may easily place the container lid portion 230 using his or her thumb or forefinger. Also, since the container lid portion 230 is formed of a silicone material, when the user holds the lid strap 2301 and then applies a force in a pulling direction, the container lid portion 230 is deformed in the pulling direction so as to minimize a frictional force between the container lid portion 230 and the container 200.

The absorber 300 of the embodiment may be disposed inside the container 200 to store saliva generated in the instrument.

In more detail, the absorber 300 of the embodiment may include one or more porous nonwoven layers and super absorbent resin particles fixed inside pores of the porous nonwoven layers. The super absorbent resin particles may be configured to be fixed by a physical fixing force caused by a mutual relationship between a size of the pores and a diameter of the super absorbent resin particles.

The absorber 300 of the embodiment may include a configuration in which the super absorbent resin particles are adequately included and physically fixed in porous nonwoven layers including pores having a size slightly larger than that of the super absorbent resin particles.

In more detail, the porous nonwoven layer in the absorber does not include a liquid adhesive composite or an additional liquid composite to fix the super absorbent resin particles inside the pores. The super absorbent resin particles are fixed in the pores only by the physical fixing force caused by the mutual relationship between the size of the pores and the diameter of the super absorbent resin particles.

Accordingly, the absorber 300 of the embodiment has an effect of effectively suppressing the super absorbent resin particles while fluff pulp, a liquid adhesive composite, or the like is not included or an extremely small amount thereof is used.

Also, since fluff pulp or the like is not used or an insignificant amount thereof is used, the absorber 300 of the embodiment may have a slimmed and thinned structure and a manufacturing cost thereof may be reduced. Also, since movement of the super absorbent resin particles in the absorber 300 is effectively suppressed by the porous nonwoven layers, uniform performance is provided. It is possible to maintain an adequate shape after a large amount of absorption. It is possible to suppress degradation of properties of the super absorbent resin particles caused by a large amount of adhesive so as to maintain excellent absorption performance and the like.

For example, the absorber 300 of the embodiment may be manufactured using the following method using an absorber manufacturing device manufactured and supplied by O-tech Company.

On a wire mesh screen of ten meshes having a width of 10 cm and a length of 40 cm, paper tissue having the same width and length as those of the screen is placed. Polypropylene Nonwoven fabric (manufacturer: Libeltex, brand name: DryWeb) which has a basis weight of 50 gsm is located thereabove, 12 g of LG SAP GS-4800N is evenly injected using an SAP dispersion injection device located above a device, and a vacuum is applied thereto so as to fix SAP particles. The manufactured absorber is carefully separated from the wire mesh screen and then a polypropylene film having a width of 20 cm and a length of 50 cm and a polypropylene nonwoven fabric (manufacturer: Freudenberg, brand name: Vilmed) having a basis weight of 16 gsm are added to top and bottom thereof. Subsequently, the film on top and nonwoven fabric on bottom are bonded to each other by spraying an adhesive to a corner part. Here, the adhesive is not applied to the manufactured absorber. The manufactured absorber goes through a roll having a width of 2 mm to be compressed.

Also, the absorber 300 of the embodiment may be provided such that a color thereof varies according to an amount of absorbed saliva.

There is a technical effect that the user can see how much saliva is collected in the absorber while the saliva collector of the embodiment is used.

In more detail, the absorber 300 of the embodiment may be provided such that a color thereof is transparent when the amount of the absorbed saliva is small and the color changes to red or blue when a certain amount or more of saliva is absorbed such that it is necessary to replace the absorber.

Here, since the container 200 of the embodiment may be formed of a plastic material such as polycarbonate (PC) and the like having an adequate mechanical property even when processed to be thin or all types of metals and plastic materials coated with metal, the user may recognize that the color of the absorber 300 accommodated in the container 200 changes.

However, since this is merely one embodiment for convenience of description, the user may manufacture the absorber 300 using a variety of methods as necessary. Also, any configuration capable of absorbing saliva moved into the container 200 may be applied, and the present invention is not limited thereto.

Figure 2:
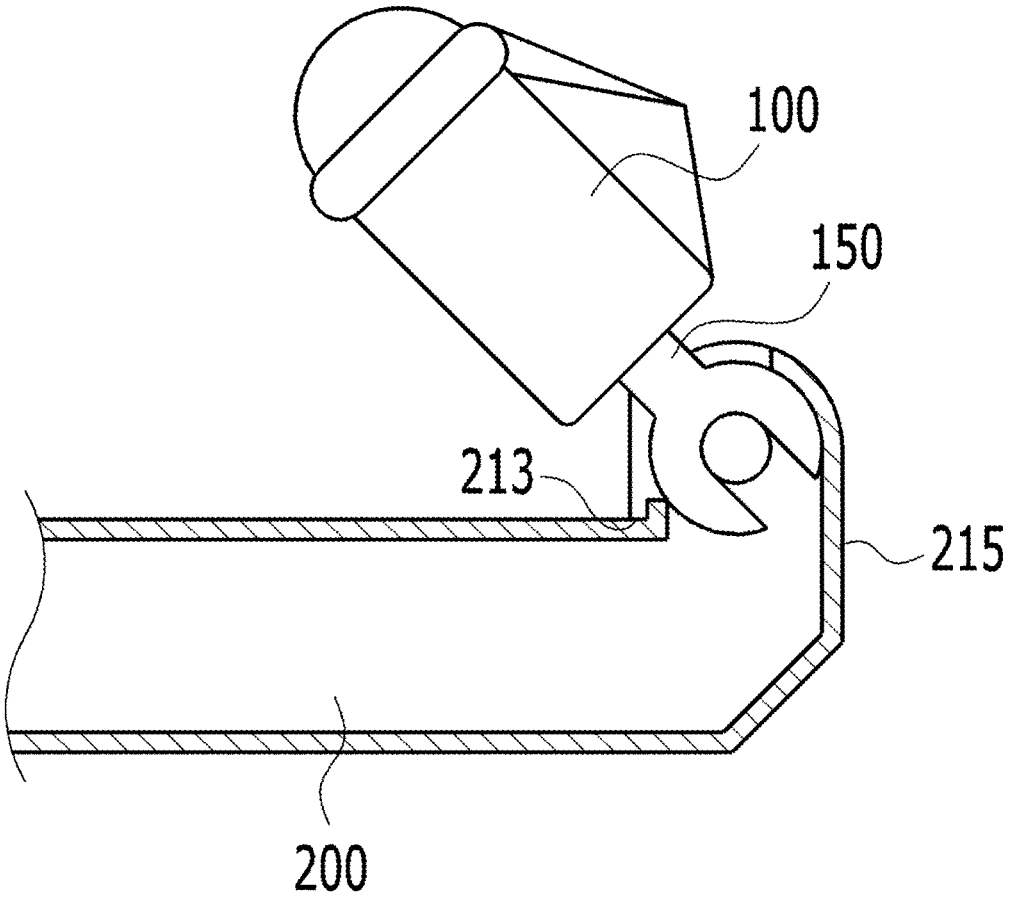
FIG. 2 illustrates a coupling relationship between a head and a container of the saliva collector according to one embodiment of the present invention.

FIG. 2 illustrates a coupling relationship between the head and the container of the saliva collector according to one embodiment of the present invention.

Referring to FIG. 2, as described above, the head 100 and the container 200 of the saliva collector of the embodiment may be provided to be pivotable by a certain angle.

Hereinafter, a coupling structure of the head 100 and the container 200 will be described in more detail.

The head 100 may be provided to be pivotable from a position at which one surface of the head 100 is parallel to one surface of the container 200 to a position at which one surface of the head is perpendicular to one surface of the container 200.

To this end, the container 200 of the embodiment may include a first inner wall portion 213 and a second inner wall portion 215 which are provided in the container 200.

The first inner wall portion 213 may be provided to come into contact with a first part of the container coupling portion 150 of the head 100, and the second inner wall portion 215 may be provided to come into contact with a second part of the container coupling portion 150 of the head 100.

Particularly, the first inner wall portion 213 may be provided to perform a function of a stopper which comes into contact with a lateral surface of the container coupling portion 150 and stops the head 100 from rotating further when the container coupling portion 150 reaches a position at which the one surface of the head 100 is parallel to the one surface of the container 200. The second inner wall portion 215 may be provided to perform a function of a stopper which comes into contact with the lateral surface of the container coupling portion 150 and stops the head 100 from rotating further when the container coupling portion 150 reaches a position at which the one surface of the head 100 is perpendicular to the one surface of the container 200.

Accordingly, the container 200 of the embodiment includes the first inner wall portion 213 and the second inner wall portion 215 so as to restrict a rotation radius of the head 100.

However, this is one embodiment for convenience of description. The first inner wall portion 213 and the second inner wall portion 215 have to only restrict the rotation radius of the head 100. The user may diversely modify the first inner wall portion 213 and the second inner wall portion 215 as necessary, and the scope of the present invention is not limited thereto.

Figure 3:
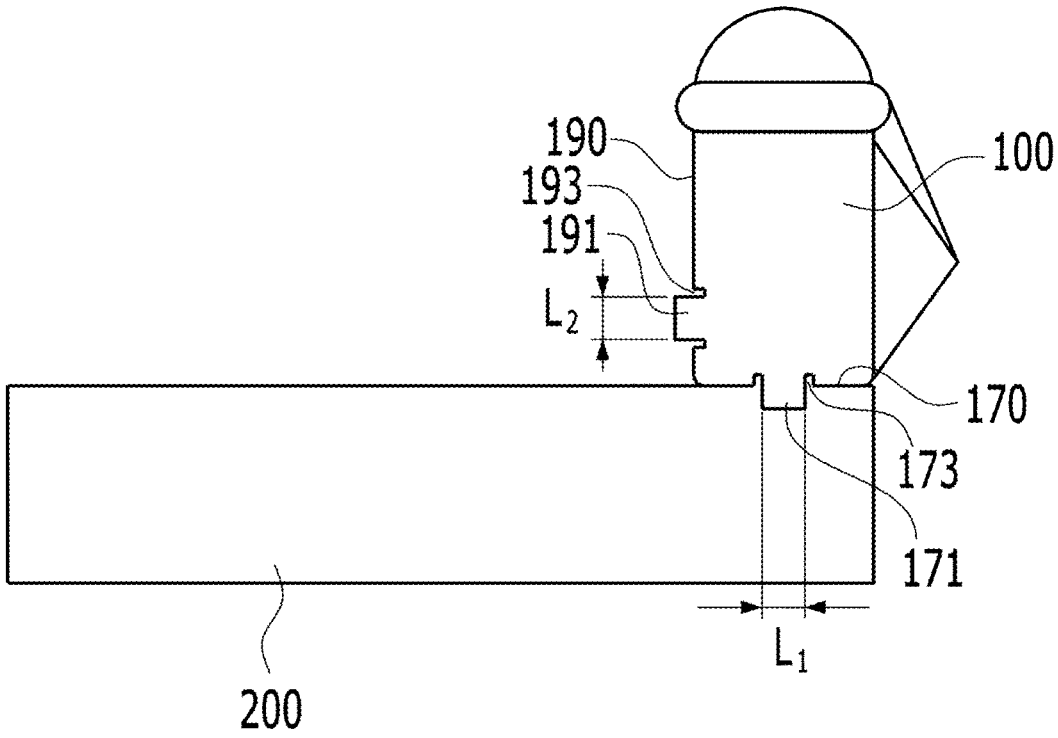
FIG. 3 illustrates a saliva collector according to another embodiment of the present invention.

FIG. 3 illustrates a saliva collector according to another embodiment of the present invention.

Referring to FIG. 3, the saliva collector of another embodiment of the present invention may include a container 200, which provides a space accommodating at least one absorber 300, and a head 100 which has one end provided to be detachable from at least a part of a musical instrument and the other end detachably provided to communicate with at least a part of one surface of the container 200.

In the saliva collector shown in FIG. 3, unlike the saliva collector shown in FIGS. 1 and 2, the head 100 and the container 200 are not provided to be rotatable.

In more detail, in order to be coupled to the container 200 the head 100 may include a first surface 170 and a second surface 190 which are configured to come into contact with one surface of the container 200.

The first surface 170 may include a first protruding portion 171 disposed to protrude from the first surface 170 to a certain height and having a hollow shape through which saliva which flows from the instrument is discharged and a first gap portion 173 formed in an outer circumferential surface of the first protruding portion 171.

The second surface 190 may include a second protruding portion 191 disposed to protrude from the second surface 190 to a certain height and a second gap portion 193 formed in an outer circumferential surface of the second protruding portion 191.

Also, the container 200 may include a hollow container accommodation portion 250 (refer to FIG. 4) which is disposed to protrude from one surface of the container 200 to a certain height and accommodates the first protruding portion 171 or the second protruding portion 191.

In FIG. 3, the saliva collector of the embodiment is formed by coupling the first protruding portion 171 to the container accommodation portion 250.

That is, when the user uses the saliva collector, the first protruding portion 171 through which saliva is discharged may be coupled to the container accommodation portion 250 so as to collect saliva discharged from the instrument in the container 200 via the head 100.

Meanwhile, when the saliva collector is not used, for example, the user moves, there is a problem that the saliva collected in the container 200 leaks outward through the container accommodation portion 250.

That is, to prevent the saliva collected in the container 200 from leaking outward, while the saliva collector of the embodiment is not used, it is necessary to close the container accommodation portion 250.

Accordingly, the head 100 of the embodiment may be coupled to the container 200 so that the second protruding portion 191 is inserted into the container accommodation portion 250.

To easily perform the above, according to the embodiment, a diameter L1 of the first protruding portion 171 and a diameter L2 of the second protruding portion 191 may be provided to be the same.

However, this is one embodiment for convenience of description. The saliva collector of the embodiment only has to easily move the saliva collected from the instrument to the container while being used and to prevent the saliva collected in the container from being discharged outward from the container while not being used. To this end, the user may diversely change shapes, positions, sizes, and the like of the first protruding portion 171 and the second protruding portion 191, and the scope of the present invention is not limited thereto.

FIGS. 4A and 4B illustrate a head and a container of a saliva collector according to another embodiment of the present invention.

Referring to FIG. 4A, the container 200 of the saliva collector of the embodiment may include the container accommodation portion 250 disposed on one surface of the container 200.

The container accommodation portion 250 may include a container accommodation opening portion 251 providing a space in which the first protruding portion 171 or the second protruding portion 191 are inserted and a container accommodation rib 253 disposed on an outer circumferential surface of the container accommodation opening portion 251 and provided to be inserted into the first gap portion 173 or the second gap portion 193.

FIG. 4B illustrates the head 100 shown in FIG. 3 in more detail. Here, the first gap portion 173 disposed on the outer circumferential surface of the first protruding portion 171, which is not shown in FIG. 3, to provide a space in which the container accommodation rib 253 is inserted and the second gap portion 193 disposed on the outer circumferential surface of the second protruding portion 191 to provide a space in which the container accommodation rib 253 is inserted are illustrated in more detail.

Since the container accommodation rib 253 is provided in the container accommodation portion 250, when the first protruding portion 171 or the second protruding portion 191 of the head 100 are inserted into the container accommodation opening portion 251, contact between the first surface 170 or the second surface 190 and one surface of the container 200 may become more hermetic.

FIGS. 5A and 5B illustrate a head and a container of a saliva collector according to another embodiment of the present invention.

Figure 4:
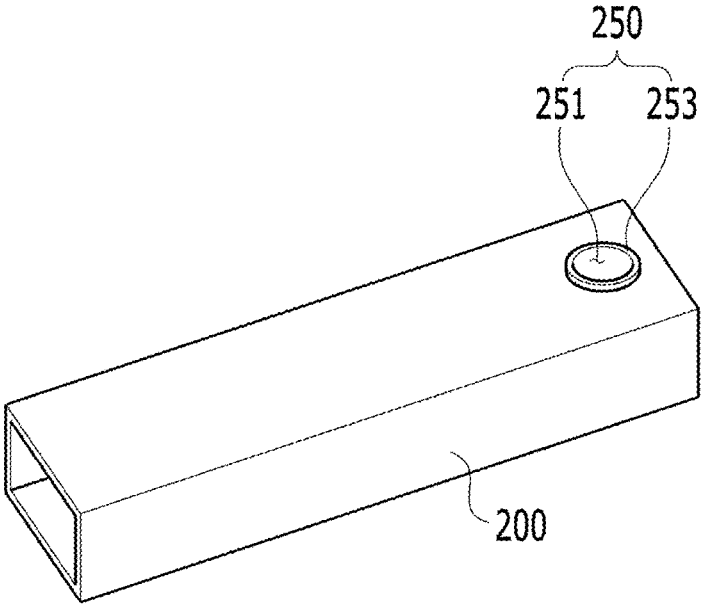
FIGS. 4A and 4B illustrate a head and a container of the saliva collector according to another embodiment of the present invention.
Figure 4:
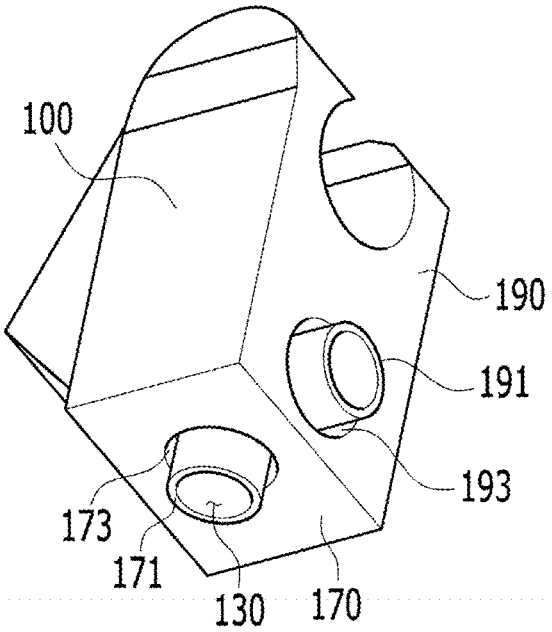
Figure 5:
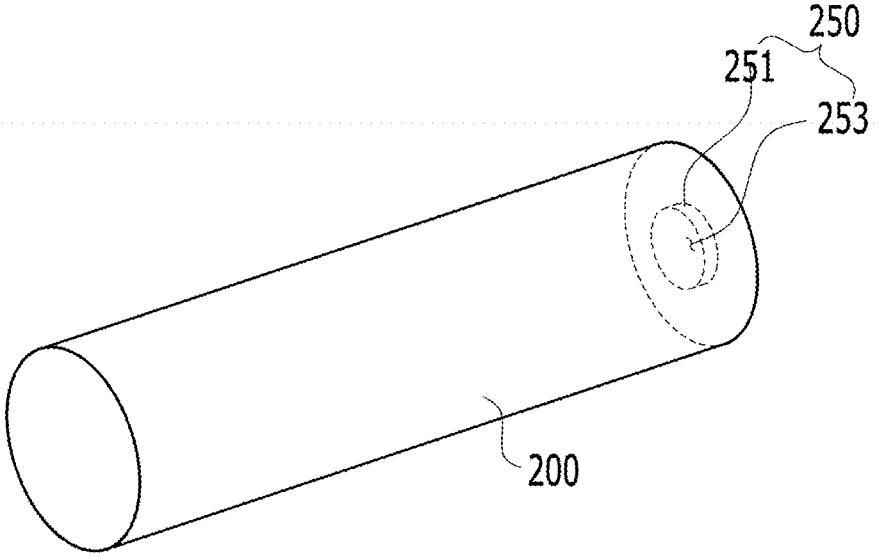
FIGS. 5A and 5B illustrate a head and a container of a saliva collector according to another embodiment of the present invention.
Figure 5:
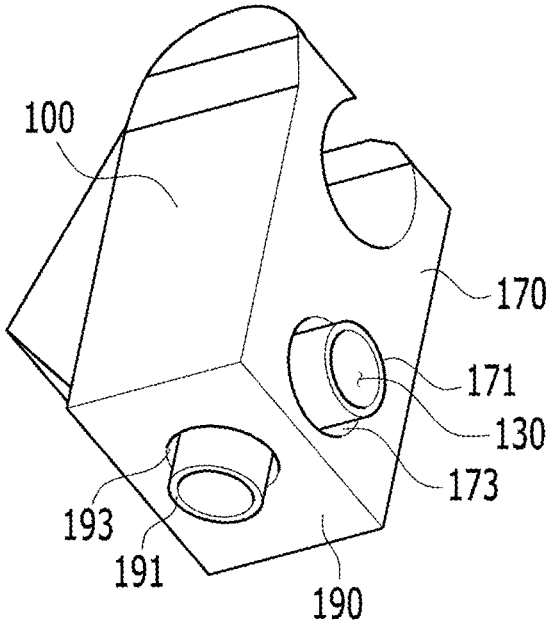

In the saliva collector shown in FIG. 5, in comparison to the saliva collector shown in FIGS. 3 and 4, since only a shape of the container 200 is different, a description of the same parts will be omitted.

A cross section of the container 200 of the embodiment may be provided as a circle.

Since a polygonal prism shape having corners is more convenient than a cylindrical shape when the user grips the saliva collector, the container 200 of the embodiment has a circular cross section so as to provide increased convenience to the user.

Meanwhile, when the container 200 has a cylindrical shape, when the container accommodation portion 250 is formed on a lateral surface of the container 200 like the container 200 shown in FIGS. 3 and 4, hermeticity of coupling is degraded such that a problem that saliva is discharged outward from the container 200 may occur.

Accordingly, to prevent the problem, the container 200 of the embodiment may include the container accommodation portion 250 on a top surface. The head 100 may have the same components as those of the head 100 shown in FIGS. 3 and 4 only while the first surface 170 and the second surface 190 are switched.

However, this is merely one embodiment for convenience of description. The user may use the container 200 shown in FIG. 5 and the head 100 shown in FIGS. 3 and 4 which does not restrict the scope of the present invention.

The instrument coupling portion 110 of the head 100 of the saliva collector of the embodiments shown in FIGS. 1 to 5 may further include a hook (not shown) provided on one surface of the instrument coupling portion 110 to protrude to a certain height and a strap (not shown) formed in a strap shape on another surface of the instrument coupling portion 110 and in which a hook opening portion (not shown) into which the hook is inserted is formed.

Since the strap is provided to surround the instrument placed on the instrument coupling portion 110 when the instrument is coupled to the head 100, there is a technical effect of improving hermeticity of coupling between the instrument coupling portion 110 and the instrument.

Also, the container 200 of the embodiments shown in FIGS. 1 to 5 may be provided to accommodate two or more absorbers 300.

It is possible to collect saliva only using one absorber 300 in the case of an average user who is not a musical instrument major. However, since a time of using an instrument is increased in the case of a musical instrument major, it is impossible to completely absorb saliva only using one absorber 300.

Accordingly, for such users, the container 200 of the embodiment may provide a space capable of accommodating two or more absorbers 300.

Figure 6:
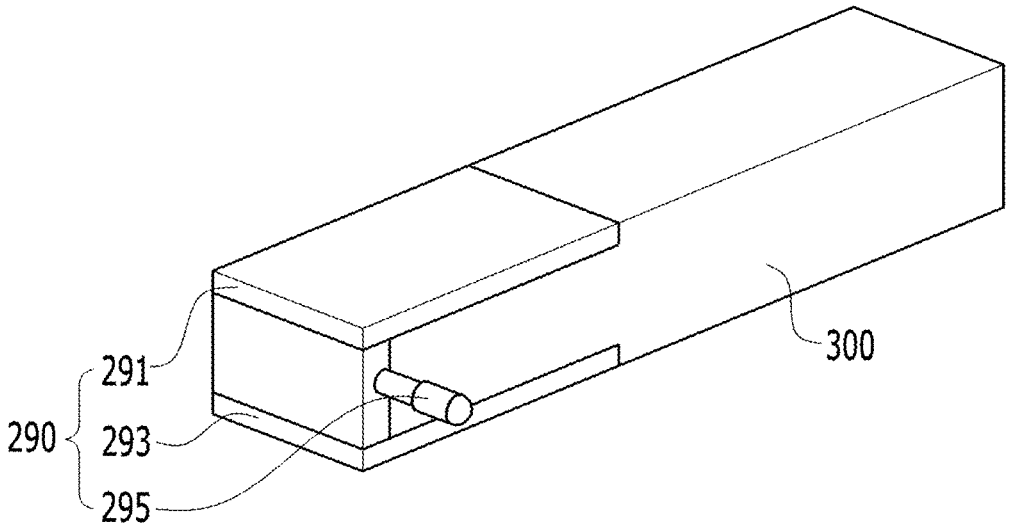
FIG. 6 illustrates a light emitting portion of a saliva collector according to another embodiment of the present invention.

FIG. 6 illustrates a light emitting portion of a saliva collector according to another embodiment of the present invention.

Referring to FIG. 6, the saliva collector of the embodiment may further include a light emitting portion 290.

The light emitting portion 290 of the embodiment may include a first pole plate 291 disposed on one surface of the absorber 300, a second pole plate 293 disposed on another surface of the absorber 300, and a light emitting diode (LED) 295 which has one end electrically connected to the first pole plate and the other end electrically connected to the second pole plate.

In more detail, the first pole plate 291 and the second pole plate 293 may have a cover shape having one open surface so as to easily come into contact with the absorber 300 and to prevent the absorber 300 from moving from the inside of the container 200 in an axial direction.

The first pole plate 291 may include copper, and the second pole plate 293 may include aluminum.

Hereinafter, an embodiment capable of allowing the LED 295 to emit light by attaching the first pole plate 291 and the second pole plate 293 to the absorber 300 will be described.

In relation thereto, the applicant performed an experiment in which the LED 295 emitted light while the first pole plate 291 including copper and the second pole plate 293 including aluminum, which had a cross section of 40 mm×17 mm and a thickness of 0.5 mm, were stacked interposing an absorber having the same area and a thickness of 15 mm therebetween and the absorber was completely wet.

As a cause of light emission of the LED 295, when the absorber is completely wet due to saliva such that an electrolyte layer, that is, water and a variety of polar particles, are formed between two metal plates, a potential difference of 0.5 V or higher is formed between the two metal layers.

Since aluminum reacts with water to produce aluminum hydroxide and electrons and since the electrons are pulled to an opposite copper surface with the electrolyte layer as a medium, a potential of aluminum becomes lower than that of copper such that a voltage is formed between the first pole plate 291 and the second pole plate 293.

$$Al+3OH \Rightarrow Al(OH)_3+3e \quad \text{[Formula 1]}$$

When the first pole plate 291 and the second pole plate 293 are installed on one end of the absorber 300 inserted into the container using the above principle, the absorber 300 completely absorbs saliva such that the absorbed saliva reaches a position at which the first pole plate 291 and the second pole plate 293 are installed. Here, a potential difference occurs between the first pole plate 291 and the second pole plate 293 such that the LED 295 is enabled to emit light so as to provide an effect of informing the user to replace the absorber 300.

Figure 7:
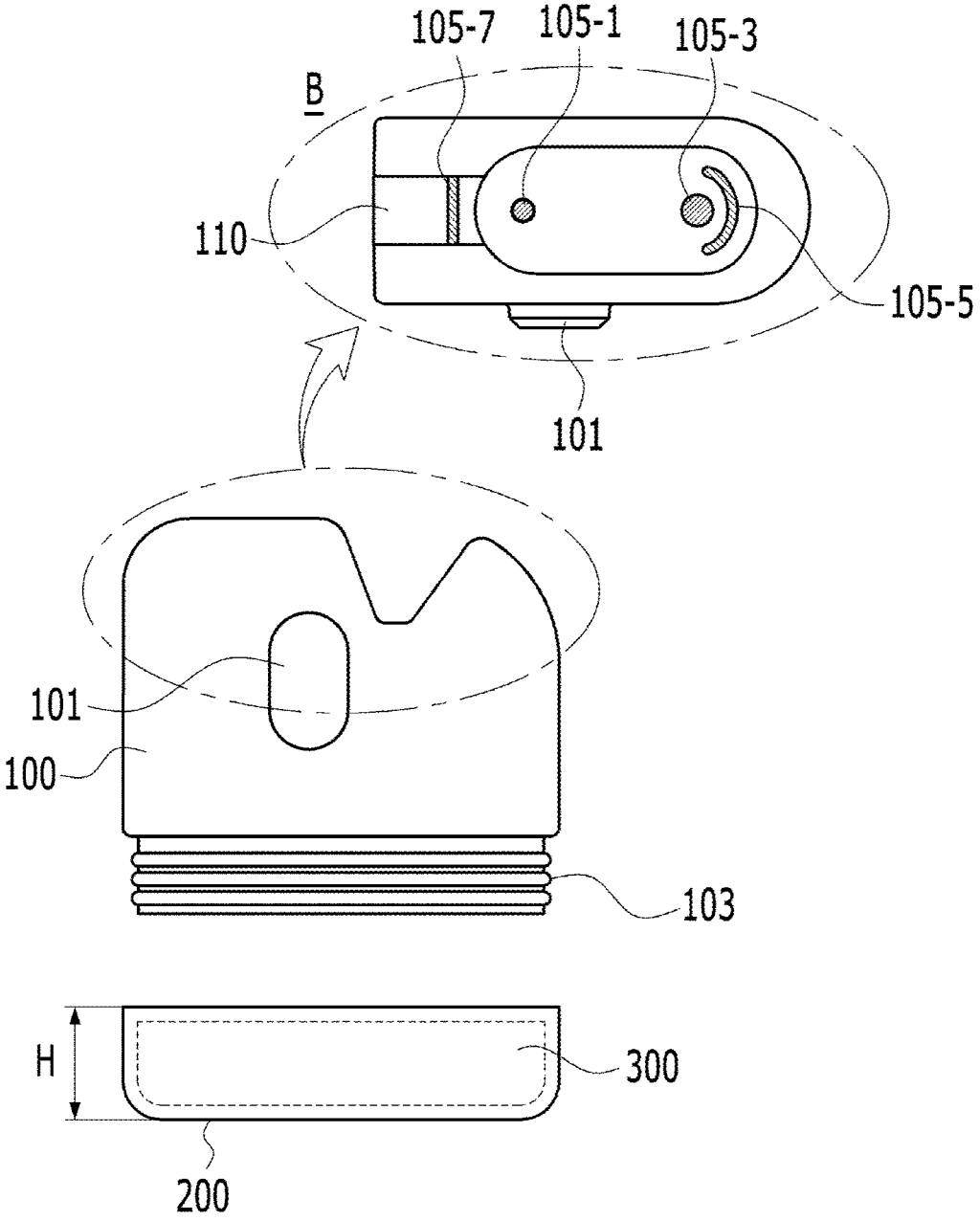
FIG. 7 illustrates a saliva collector according to another embodiment of the present invention.

FIG. 7 illustrates a saliva collector according to another embodiment of the present invention.

Referring to FIG. 7, the saliva collector according to another embodiment may include a head 100 which has one end provided to be detachable from an instrument and internally communicates with a water key of the instrument to provide a flow path through which saliva discharged from the water key moves and a container 200 which provides a space accommodating an absorber 300 storing the saliva moved through the head 100.

A shape of one surface of a coupling portion of the head 100 of the saliva collector of the embodiment which is coupled to the instrument may be a shape protruding outward.

In consideration that shapes of water keys of instruments differ for each brand and a pivot angle of a general water key is about 40 degrees to 90 degrees, an effect of preventing interference with the water key when any brand of instrument is coupled is present.

Meanwhile, the head 100 may further include a sealing structure 103 provided to extend downward.

The sealing structure 103 may include an at least a triple seal structure for airtightness of coupling between the container 200 and the head 100.

Accordingly, there is an effect of effectively preventing saliva which flows into the head 100 or the container 200 from leaking outward.

Meanwhile, a height H of the container 200 of the embodiment may be 5 mm to 20 mm which may be provided for capacity options of the absorber 300 according to a use amount for each user.

In more detail, in the case of an average person who is not a musical instrument major, it is possible to absorb saliva generated during training time only using one absorber 300. On the other hand, in the case of a musical instrument major, it is possible to effectively absorb saliva using at least two absorbers 300. To compensate for an amount of saliva generated while an instrument is played varies according to age, gender, build, and the like, it is necessary to form the height H of the container 200 to be within a range of 5 mm to 20 mm.

At least two holes and slits may be included on a top surface of an inside of the head 100 of the embodiment.

In more detail, on the top surface of the inside of the head 100 of the embodiment, a first head portion hole 105-1 provided at one end of the top surface, a second head portion hole 105-3 provided opposite the first head portion hole 105-1, a first head portion slit 105-5 provided in a lateral surface of the second head portion hole 105-3, and a second head portion slit 105-7 provided in a lateral surface of the head portion hole 105-1 may be provided.

The first head portion hole 105-1, the second head portion hole 105-3, and the first head portion slit 105-5 perform a function of a ventilation structure for allowing a mixture of saliva and water to easily flow into the head 100.

The second head portion slit 105-7 performs, when saliva spatters an external pipe of a main slide of an instrument due to a high pressure generated when the saliva collector of the embodiment is used while being coupled to the main slide, a function of allowing the saliva to flow into the container again.

However, the above ventilation structure is merely one example for convenience of description. The user may make a variety of modifications thereof as necessary, and the scope of present invention is not limited thereto.

A button portion 101 which provides a space in which a button of an instrument is accommodable may be provided on at least one lateral surface of the head 100 of the present invention.

In the case of a brass instrument, it is common to include a lever-type water key. However, a button-type water key which discharges saliva inside the instrument by pushing a button formed on one side or a ring-type water key which discharges saliva in the instrument by pressurizing a ring formed on an outer circumferential surface may be included.

Since the button portion 101 is provided on the head 100 of the present invention, there is an effect of being used not only in an instrument including a general lever-type water key but also an instrument including a button-type or ring-type water key.

Figure 8:
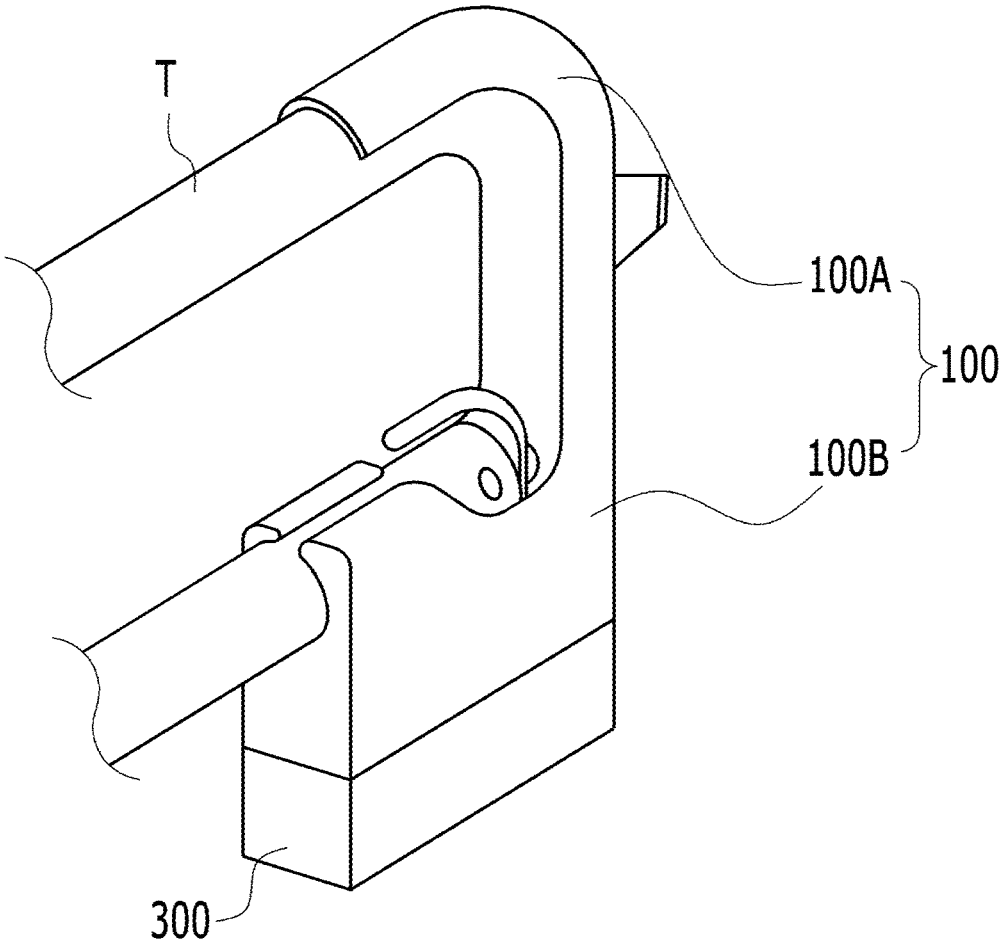
FIG. 8 illustrates a saliva collector according to another embodiment of the present invention.

FIG. 8 illustrates a saliva collector according to another embodiment of the present invention.

In the case of a trombone among brass instruments, a situation in which a slide quickly moves during playing occurs such that a problem may occur in which the saliva collector shown in FIGS. 1 to 7, which is mounted on an end of the slide, moves relatively and is separated.

Accordingly, the head 100 of the saliva collector according to another embodiment of the present invention may include a lateral fixing head 100A provided to surround an end of a slide and a lower fixing head 100B provided to surround a bottom end of the slide.

The lateral fixing head 100A may include a closed portion at the end of the slide which has a stapler shape to protrude forward from the closed portion to a certain length.

The lower fixing head 100B may be provided to extend from the lateral fixing head 100A and have the same shape as that of the head 100 of the saliva collector of FIG. 7 which has been described above.

That is, as described above, in the saliva collector according to another embodiment of the present invention, since the lateral fixing head 100A and the lower fixing head 100B fix three surfaces of the slide at the same time, an effect is provided of preventing the saliva collector from deviating from the instrument in spite of rapid movement of the slide.

It is apparent that the present invention may be detailed in other particular forms without departing from the concept and essential features of the present invention. Accordingly, the above detailed description should not be construed as limitative and should be considered as an example in all aspects. The scope of the present invention should be determined through reasonable interpretation on the claims, and all changes within an equivalent range of the present invention will be included in the scope of the present invention.

INDUSTRIAL APPLICABILITY

The present invention relates to a device, which absorbs saliva of a brass instrument, and is applicable to the field of auxiliary devices for an instrument.

The invention claimed is:

1. A saliva collector comprising:

a container configured to provide a space which accommodates at least one absorber; and a head which has one end provided to be detachable from at least a part of an instrument and the other end provided to be detachable to communicate with at least a part of one surface of the container;

wherein the head further comprises a sealing structure extended downward to be coupled with the container.

2. The saliva collector of claim 1, wherein the container comprises:

a head coupling portion provided on one end of the container and coupled to the head;

a container opening portion provided on the other end of the container to provide an inlet through which the absorber moves in or out; and a container lid portion provided to be detachable from the container opening portion, and wherein the head comprises:

an instrument coupling portion provided on one end of the head to provide a space which accommodates the at least a part of the instrument and provided to be couplable to at least a part of the instrument using a fitting method;

a container coupling portion provided on the other end of the head and pivotably coupled to the container; and a saliva flow path portion which has one end provided on the instrument coupling portion and the other end provided on the container coupling portion to provide a flow path through which saliva discharged from the instrument moves.

3. The saliva collector of claim 2, wherein the head coupling portion comprises at least one container rib provided to protrude inward to a certain height, wherein the container coupling portion comprises at least one head recess provided to be recessed to a certain height to accommodate the container protruding portion, and wherein the head recess comprises at least one tapered surface provided at a bottom to be tilted at a certain angle.

4. The saliva collector of claim 2, wherein the instrument coupling portion comprises at least one rib provided on an outer surface of the instrument coupling portion to protrude to a certain height.

5. The saliva collector of claim 1, wherein a first surface of the head comprises:

a first protruding portion disposed to protrude from the first surface to a certain height and having a hollow shape through which saliva flowing from the instrument is discharged; and a first gap portion formed on an outer circumferential surface of the first protruding portion, wherein a second surface of the head comprises:

a second protruding portion disposed on the second surface to protrude to a certain height; and a second gap portion formed on an outer circumferential surface of the second protruding portion, and wherein the container comprises a hollow container accommodation portion disposed on one surface of the container to protrude to a certain height and in which the first protruding portion or the second protruding portion is accommodated.

6. The saliva collector of claim 5, wherein when the container and the head are coupled, an inner surface of the container accommodation portion is provided to come into surface contact with an outer surface of the first protruding portion or an outer surface of the second protruding portion.

7. The saliva collector according to claim 1, wherein the container is formed of a transparent material, and wherein the absorber is provided to vary in color when a preset amount or more of water is absorbed.

8. The saliva collector according to claim 1, wherein the instrument coupling portion comprises:

a hook provided on one surface of the instrument coupling portion to protrude to a certain height; and a strap provided in a strap shape on the one surface of the instrument coupling portion and comprising a hook opening portion into which the hook is inserted.

9. The saliva collector according to claim 1, wherein the container comprises:

a first pole plate provided inside the container to come into contact with one surface of the absorber;

a second pole plate provided inside the container to come into another surface of the absorber;

a light emitting diode (LED) which has one end provided to be electrically connected to the first pole plate and the other end provided to be electrically connected to the second pole plate and which emits light when a preset amount or more of water is absorbed by the absorber; and an LED opening portion provided on one surface of the container to accommodate the LED.

10. The saliva collector of claim 1, wherein a top surface of an inside of the head comprises a plurality of holes and a plurality of slits.

11. The saliva collector of claim 1, wherein the head comprises a button portion in a lateral surface, which is configured to provide a space in which a lateral part of a water key provided in the instrument is accommodated.

* * * * *